US009069326B2

(12) United States Patent
Onishi et al.

(10) Patent No.: US 9,069,326 B2
(45) Date of Patent: Jun. 30, 2015

(54) IMAGE FORMATION APPARATUS

(71) Applicant: KYOCERA Document Solutions Inc., Osaka (JP)

(72) Inventors: Yuzo Onishi, Osaka (JP); Yoshiyuki Asakawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/340,071

(22) Filed: Jul. 24, 2014

(65) Prior Publication Data

US 2015/0037058 A1 Feb. 5, 2015

(30) Foreign Application Priority Data

Jul. 30, 2013 (JP) ..... 2013-157691

(51) Int. Cl.
*G03G 21/16* (2006.01)

(52) U.S. Cl.
CPC ..... *G03G 21/1633* (2013.01); *G03G 21/1652* (2013.01); *G03G 21/1695* (2013.01); *G03G 2215/00544* (2013.01)

(58) Field of Classification Search
CPC ..... G03G 21/1623–21/1638; G03G 21/1695; G03G 21/165; G03G 2215/00544
See application file for complete search history.

(56) References Cited

U.S. PATENT DOCUMENTS

| | | | | |
|---|---|---|---|---|
| 3,800,328 | A * | 3/1974 | Harlan et al. | 360/137 |
| 2007/0147882 | A1 | 6/2007 | Igarashi | 399/110 |
| 2008/0232847 | A1 | 9/2008 | Kusukawa et al. | 399/114 |
| 2011/0142488 | A1* | 6/2011 | Yamashita | 399/110 |

FOREIGN PATENT DOCUMENTS

| | | | |
|---|---|---|---|
| JP | 2006-315826 | A | 11/2006 |
| JP | 2010-122359 | A | 6/2010 |
| JP | 2013-15757 | A | 1/2013 |
| JP | 2013-61468 | A | 4/2013 |

* cited by examiner

*Primary Examiner* — David Gray
*Assistant Examiner* — Sevan A Aydin
(74) *Attorney, Agent, or Firm* — Stein IP, LLC

(57) ABSTRACT

An image formation apparatus comprises an opening and closing cover, a cover fulcrum shaft, a roller shaft, and a grounding member. The cover fulcrum shaft pivotably supports the opening and closing cover. The roller shaft is disposed on the opening and closing cover. The grounding member has a first portion connected to the roller shaft and a second portion connected to the cover fulcrum shaft. The cover fulcrum shaft has a bent part that is bent so as to extend in a direction intersecting the pivot axis direction of the opening and closing cover, the opening and closing cover includes an engaging part that engages with the bent part, and the cover fulcrum shaft integrally pivots with the opening and closing cover when the opening and closing cover is opened and closed.

9 Claims, 10 Drawing Sheets

IMAGE FORMATION APPARATUS

CROSS-REFERENCE TO RELATED APPLICATIONS

This application is based upon and claims the benefit of priority from the corresponding Japanese Patent Application No. 2013-157691, filed Jul. 30, 2013, the entire contents of which are incorporated herein by reference.

BACKGROUND OF THE INVENTION

The present disclosure relates to an image formation apparatus comprising an opening and closing cover pivotably supported on an apparatus main body.

Image formation apparatuses include those which convey a paper along a paper conveying path and print an image on the paper. In such an image formation apparatus, when a jam occurs in the paper conveying path, the paper must be taken out of the paper conveying path. Therefore, part of an outer cover of the image formation apparatus is made into an opening and closing cover, and opening the opening and closing cover causes the inner side of the paper conveying path to become exposed.

For example, the paper conveying path extends along a side surface of the image formation apparatus. In this case, part of a side surface cover of the image formation apparatus is made into an opening and closing cover. Of a pair of conveying rollers forming a conveying nip in the paper conveying path, one conveying roller is disposed inside the apparatus, and the other conveying roller is disposed on the opening and closing cover. The inner side of the paper conveying path is thereby exposed when the opening and closing cover is opened, and the pair of conveying rollers separate from each other. The paper stopped clogging the paper conveying path can thereby be easily taken out.

In an image formation apparatus for conveying paper along a paper conveying path and printing an image on the paper, to suppress the accumulation of static electricity in the conveying rollers, the roller shafts of the conveying rollers are grounded to a main body frame of the apparatus main body, whereby static electricity occurring in the conveying rollers is released to the main body frame. In the conveying roller disposed on the opening and closing cover, for example, the roller shaft is grounded to the main body frame via a cover fulcrum shaft for pivotably supporting the opening and closing cover on the main body frame. Specifically, a grounding member is disposed on the opening and closing cover, and the roller shaft and the cover fulcrum shaft are electrically connected via the grounding member.

For example, the cover fulcrum shaft is attached to the main body frame so as to not rotate, and the opening and closing cover is supported on the cover fulcrum shaft so as to pivot about the cover fulcrum shaft. Specifically, when the opening and closing cover is opened and closed, the cover fulcrum shaft does not pivot integrally with the opening and closing cover. With such a configuration, the grounding member is made springy and the grounding member is pushed into and brought in contact with the cover fulcrum shaft, for example, whereby an electrical connection is established between the cover fulcrum shaft and the grounding member. Contact between the grounding member and the cover fulcrum shaft is thereby maintained even when the opening and closing cover is opened and closed.

However, when the opening and closing cover is opened and closed, the grounding member slides along the peripheral surface of the cover fulcrum shaft, and the contact position of the grounding member on the cover fulcrum shaft is displaced. Therefore, there is a risk that the grounding member will be cut or that the contact pressure between the grounding member and the cover fulcrum shaft will change. When the grounding member is cut or the contact pressure changes, faults occur readily in the electrical connection between the grounding member and the cover fulcrum shaft.

SUMMARY OF THE INVENTION

An image formation apparatus according to one aspect of the present disclosure comprises an opening and closing cover, a cover fulcrum shaft, and a roller shaft. The opening and closing cover is pivotably supported on a main body frame of an apparatus main body. The cover fulcrum shaft pivotably supports the opening and closing cover on the main body frame. The roller shaft, which is disposed on the opening and closing cover, rotatably supports a conveying roller for conveying a recording medium. The image formation apparatus also comprises a grounding member. The grounding member, which is disposed on the opening and closing cover, has a first portion electrically connected to the roller shaft and a second portion electrically connected to the cover fulcrum shaft, and the purpose of the grounding member is to ground the roller shaft to the main body frame via the cover fulcrum shaft. The cover fulcrum shaft has a bent part that is bent so as to extend in a direction intersecting the pivot axis direction of the opening and closing cover, the opening and closing cover includes an engaging part capable of engaging with the bent part, and due to the engaging of the bent part with the engaging part, the cover fulcrum shaft integrally pivots with the opening and closing cover when the opening and closing cover is opened and closed.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS (Overall Configuration of Image Formation Apparatus)

Figure 1:
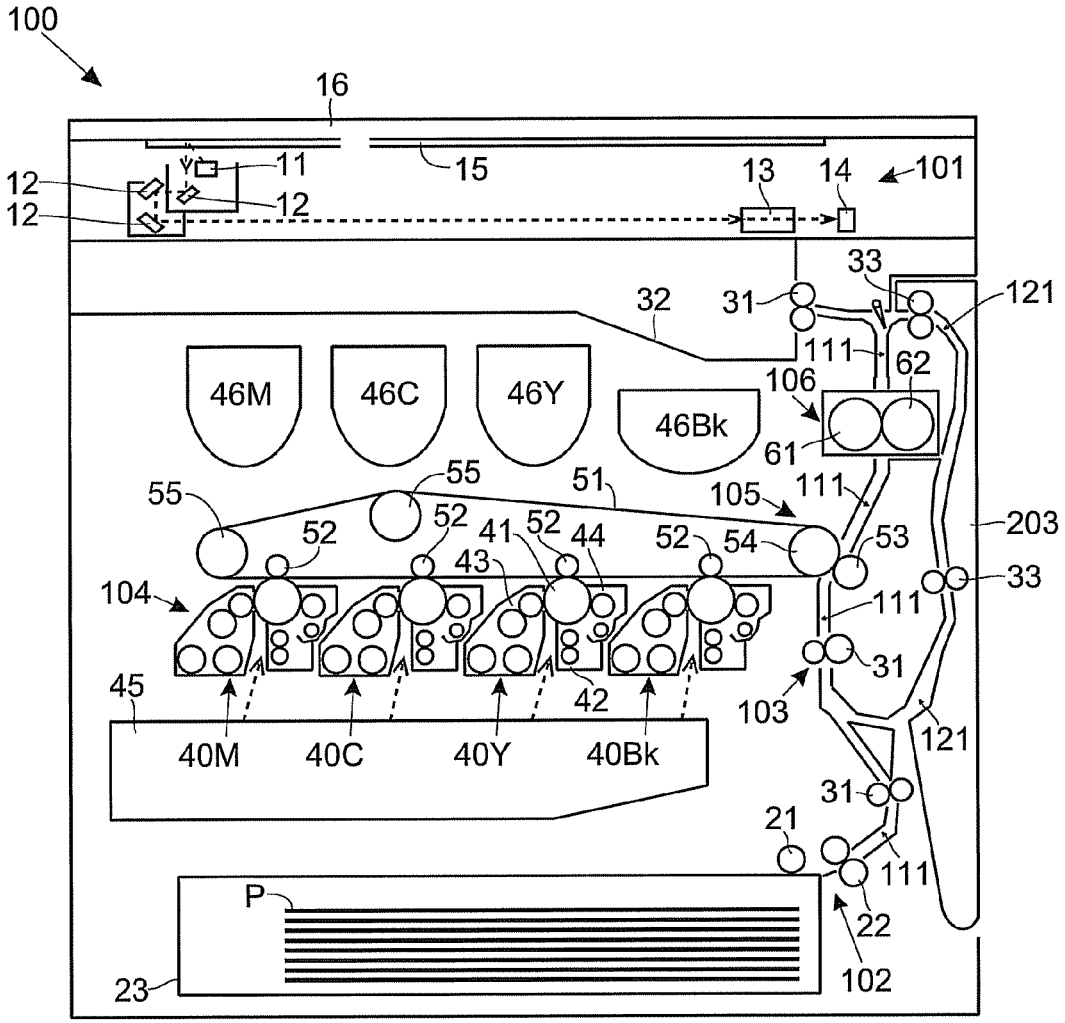
FIG. 1 is a schematic view of an image formation apparatus according to an embodiment of the present disclosure.

An image formation apparatus 100 of the present embodiment comprises an image reading section 101, a paper supply section 102, a paper conveying section 103, a toner image formation section 104, a transfer section 105, and a fixing section 106, as shown in FIG. 1. The image formation apparatus 100 also comprises a main conveying path 111 and a reverse conveying path 121 as conveying paths for conveying the paper P.

The image reading section 101 includes a light 11, a mirror 12, a lens 13, and an image sensor 14, and an image of a document placed on contact glass 15 is optically read to create image data. A document press 16 for pressing the document is provided on the contact glass 15.

The paper supply section 102 includes a pickup roller 21 and a paper supply roller pair 22 disposed in a paper supply port of the main conveying path 111, and paper P accommodated in a paper cassette 23 is supplied to the main conveying path 111. The paper conveying section 103 includes a plurality of conveying roller pairs 31 disposed along the main conveying path 111, and paper P supplied to the main conveying path 111 is conveyed sequentially to a transfer nip and a fixing nip and ejected to an ejection tray 32. The paper conveying section 103 includes a plurality of reversing roller pairs 33 for conveying the paper P along the reverse conveying path 121.

The toner image formation section 104 includes photosensitive drums 41, electrification devices 42, a developing device 43, a drum cleaning devices 44, and an exposure device 45. The toner image formation section 104 is classified into mechanical sections 40Bk, 40Y, 40C, and 40M corresponding respectively to the colors black, yellow, cyan, and magenta. The mechanical sections 40Bk, 40Y, 40C, and 40M of the toner image formation section 104 each have one photosensitive drum 41, electrification device 42, developing device 43, and drum cleaning device 44; the photosensitive drums 41 are disposed on the outer side of an intermediate transfer belt 51, described hereinafter, so as to be in contact with the intermediate transfer belt 51, and a toner image of the corresponding color is formed and transferred to the intermediate transfer belt 51. The exposure device 45, which is used by all the colors, forms an electrostatic latent image on the photosensitive drums 41. Toners of the different colors are accommodated in respective toner containers 46Bk, 46Y, 46C, and 46M.

The transfer section 105 includes the intermediate transfer belt 51, primary transfer rollers 52, and a secondary transfer roller 53, and the toner images formed in the toner image formation section 104 are transferred to the paper P. The intermediate transfer belt 51 is stretched by a drive roller 54 and a driven roller 55. The primary transfer rollers 52 are disposed on the inner side of the intermediate transfer belt 51, and the intermediate transfer belt 51 is sandwiched between the primary transfer rollers and the photosensitive drums 41. The secondary transfer roller 53 is disposed so as to face the drive roller 54 with the intermediate transfer belt 51 in between, and the secondary transfer roller forms a transfer nip with the intermediate transfer belt 51.

The fixing section 106 includes a heating roller 61 and a pressure roller 62, and toner images transferred to the paper P are fixed by heat and pressure. The heating roller 61 has a built-in heat source. The pressure roller 62 presses against the heating roller 61 and forms a fixing nip with the heating roller 61.

When a one-sided printing job is executed, paper P printed on one side is send from the fixing nip to the ejection tray 32. When a two-sided printing job is executed, the paper P printed on one side is sent from the fixing nip to the reverse conveying path 121, and is returned to a position in the main conveying path 111 that is farther upstream in the paper conveying direction than the position of the transfer nip. The paper P printed on one side is conveyed along the main conveying path 111, and the paper passes again through the transfer nip and the fixing nip. Because the front and back of the paper P are reversed at this time, printing is performed on the back of the paper P (the unprinted side).

(Configuration of Outer Cover)

Figure 2:
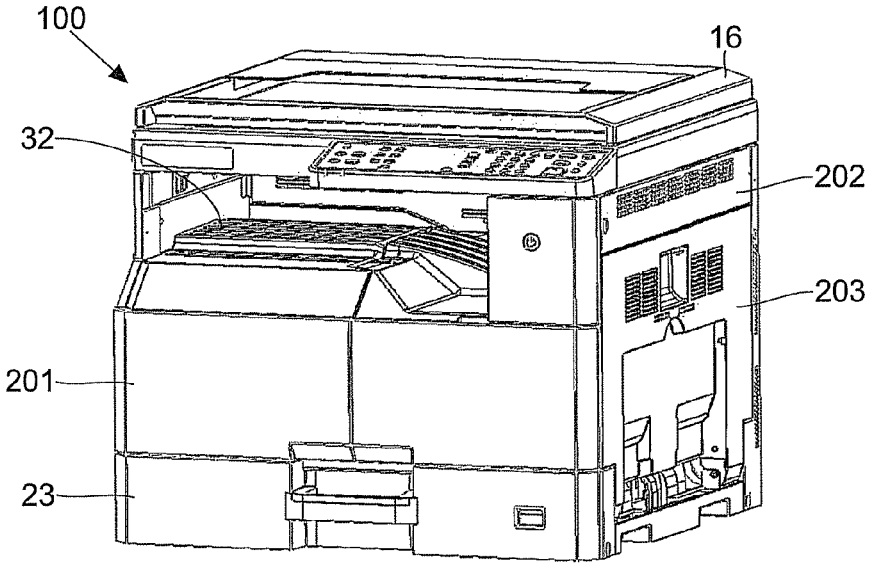
FIG. 2 is a drawing for describing the configuration of the outer cover of the image formation apparatus shown in FIG. 1.
Figure 3:
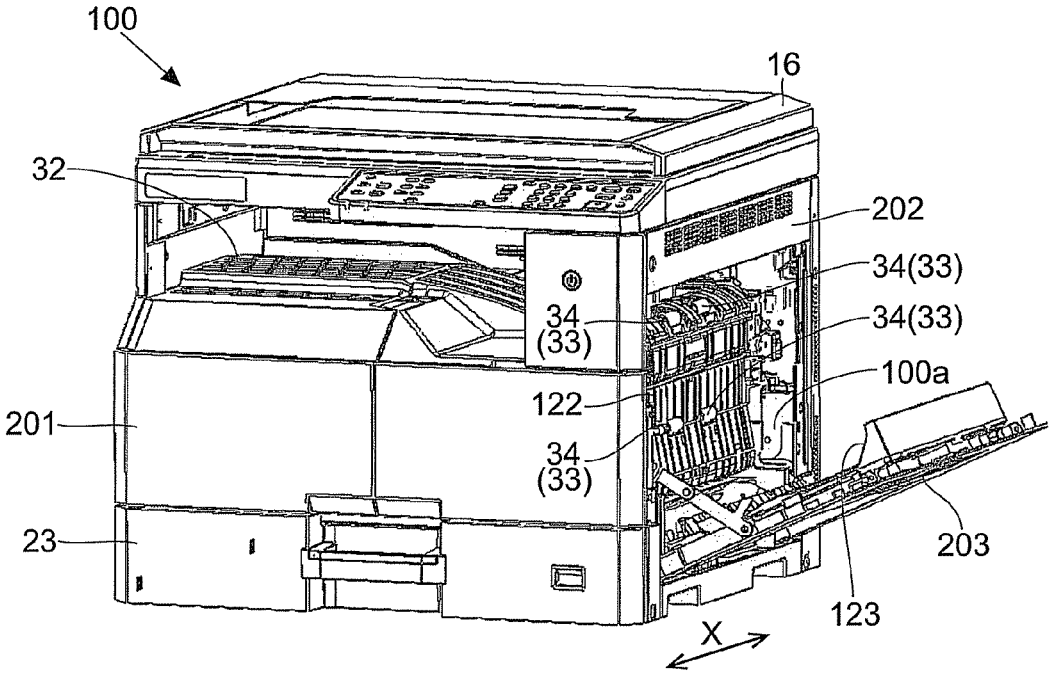
FIG. 3 is a drawing for describing the configuration of the outer cover of the image formation apparatus shown in FIG. 1 (when the opening and closing cover has been opened).
Figure 4:
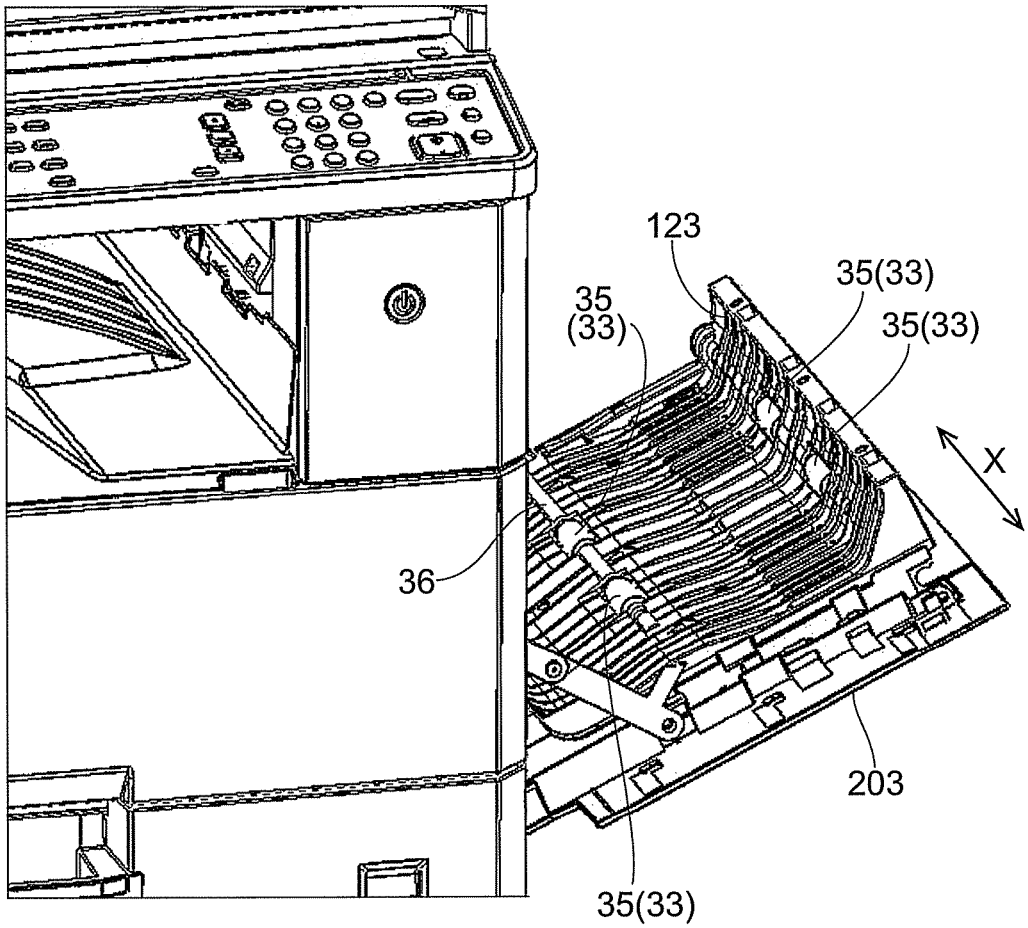
FIG. 4 is a drawing for describing the configuration of the outer cover of the image formation apparatus shown in FIG. 1 (a detailed drawing of the units provided to the inner surface of the opening and closing cover).

The image formation apparatus 100 is covered by the outer cover so that the interior of the apparatus is not exposed, as shown in FIGS. 2 and 4. For example, the outer cover includes components such as a front surface cover 201 disposed on the front surface of the apparatus, a side surface cover 202 disposed on the side surface of the apparatus, and a rear surface cover (not shown) disposed on the rear surface of the apparatus. Part of the side surface cover 202 is pivotably supported on a main body frame 100*a* of the apparatus main body. Specifically, part of the side surface cover 202 can be opened and closed relative to the apparatus main body. The portion of the side surface cover 202 that can be opened and closed relative to the apparatus main body is referred to below as the opening and closing cover 203.

A guide frame 122 having a plurality of guide ribs is provided to a predetermined position inside the apparatus that faces the inner surface of the opening and closing cover 203 when the opening and closing cover 203 is closed, and a guide frame 123 having a plurality of guide ribs is provided to the inner surface of the opening and closing cover 203. Therefore, when the opening and closing cover 203 is closed, the guide frames 122 and 123 face each other. The area enclosed by the guide frames 122 and 123 facing each other at this time is the reverse conveying path 121 (see FIG. 1). Specifically, the paper P conveyed along the reverse conveying path 121 is guided by the guide frames 122 and 123.

Of the reversing rollers 34 and 35 constituting the reversing roller pairs 33, one set of reversing rollers 34 is disposed inside the apparatus, and the other set of reversing rollers 35 is disposed on the inner surface of the opening and closing cover 203. When the opening and closing cover 203 is closed, the reversing rollers 35 press against the reversing rollers 34, and conveying nips are formed. The reversing rollers 35 are equivalent to the "conveying rollers" of the present disclosure.

When the opening and closing cover 203 is opened, the inner side of the reverse conveying path 121 is exposed, and the reversing rollers 34 and 35 separate from each other. Therefore, when a jam has occurred in the reverse conveying path 121, a jam process can be performed by opening the opening and closing cover 203.

The reversing rollers 35 are attached to roller shafts 36 extending in a direction orthogonal to the paper conveying direction. The roller shafts 36 are axially supported at both ends by bearings 37 (see FIG. 10), and are attached to a guide frame 123 (the opening and closing cover 203). The reversing rollers 35 attached to the inner surface of the opening and closing cover 203, the guide frame 123, and other components constitute a single unit, and as a unit these components can be attached and removed.

(Opening and Closing Structure of Opening and Closing Cover)

Figure 5:
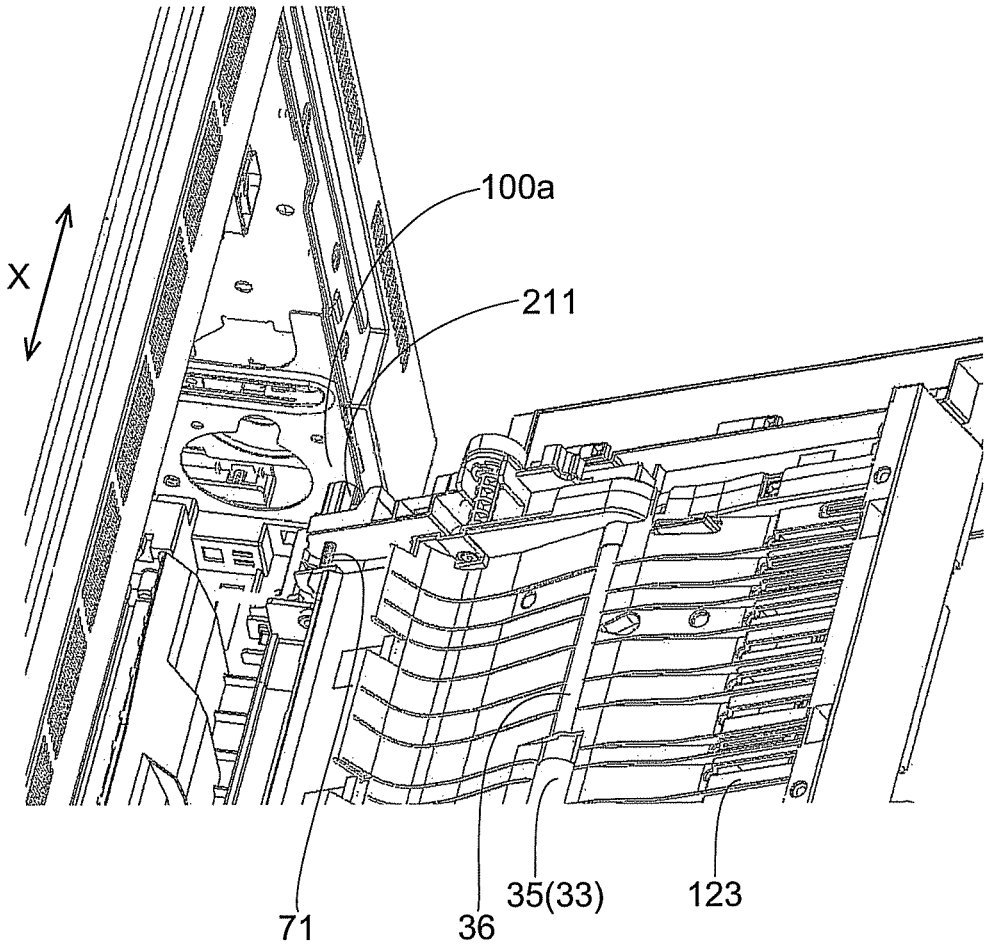
FIG. 5 is a drawing for describing the opening and closing structure of the opening and closing cover of the image formation apparatus shown in FIG. 1.
Figure 6:
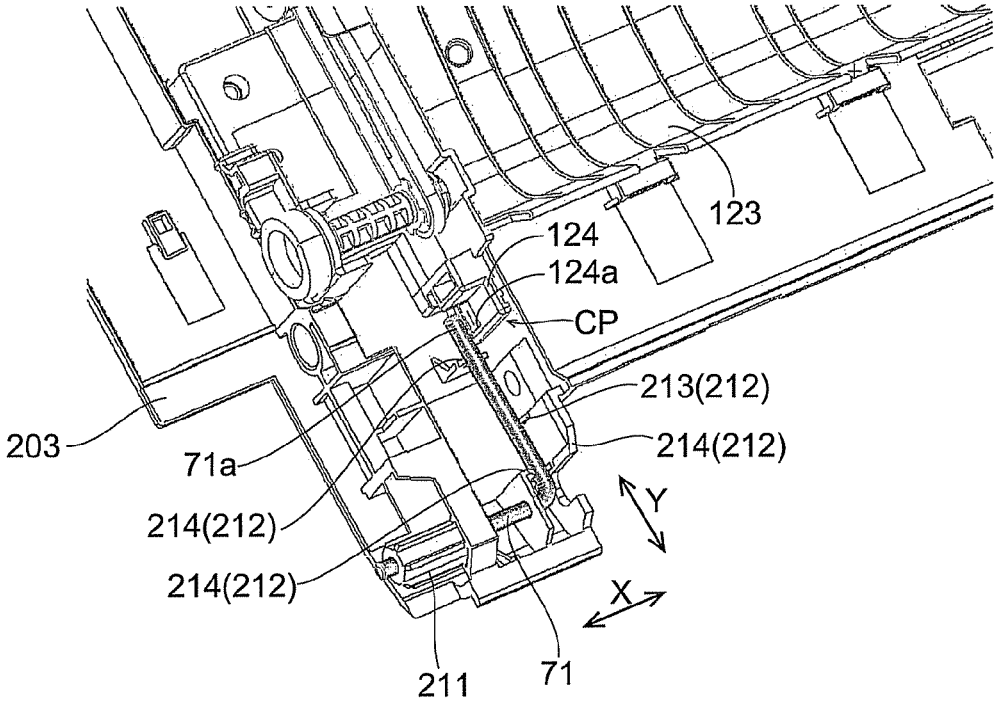
FIG. 6 is a drawing for describing the opening and closing structure of the opening and closing cover of the image formation apparatus shown in FIG. 1 (a detailed drawing of the cover fulcrum shaft and the periphery thereof).
Figure 7:
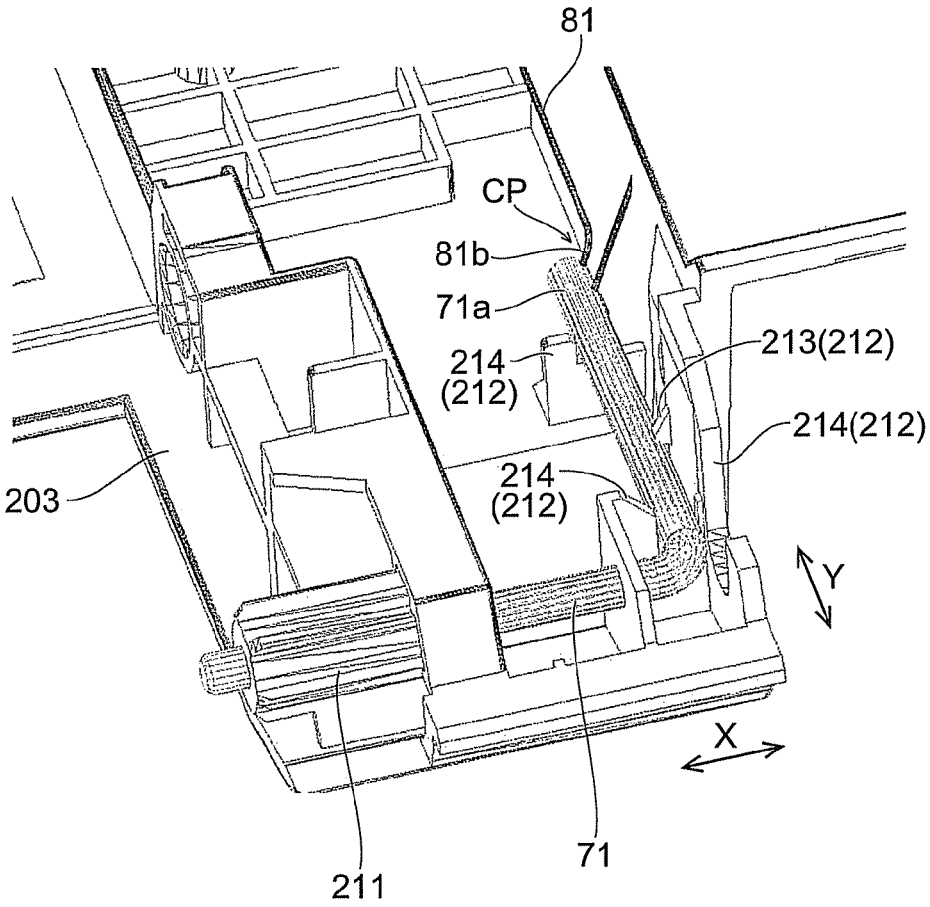
FIG. 7 is a drawing for describing the opening and closing structure of the opening and closing cover of the image formation apparatus shown in FIG. 1 (a drawing of the electrically connected state of the cover fulcrum shaft and the grounding member).

The opening and closing cover 203 is provided with a support part 211 having an engaging hole passing through the opening and closing cover 203 in the pivot axis direction (referred to below as the X direction), as shown in FIGS. 5 to 7. Inserted through the support part 211 is a cover fulcrum shaft 71 for pivotably (openably and closeably) supporting the opening and closing cover 203 on the apparatus main body. With the cover fulcrum shaft 71 inserted through the support part 211, the tip portion thereof protrudes from the support part 211. The tip portion of the cover fulcrum shaft 71 protruding from the support part 211 is axially supported in a bearing part (not shown) provided to the main body frame 100*a*. The opening and closing cover 203 can thereby pivot relative to the apparatus main body.

The cover fulcrum shaft 71 has a bent part 71*a* which is bent so as to extend in a direction (referred to below as the Y direction) orthogonal to the X direction. Specifically, the shape of the cover fulcrum shaft 71 is bent into a substantial L shape (substantially right-angled). The bent part 71*a* of the cover fulcrum shaft 71 engages in an engaging part 212 provided to the opening and closing cover 203. Due to the bent part 71*a* engaging in the engaging part 212, the cover fulcrum shaft 71 is held so as to pivot integrally with the opening and closing cover 203 when the opening and closing cover 203 is opened and closed. Specifically, the cover fulcrum shaft 71 is held so as to not pivot relative to the opening and closing cover 203.

The engaging part 212 has a protruding part 213 and wall parts 214. The protruding part 213 protrudes from one part of the wall parts 214 toward the pivot path of the bent part 71*a* of the cover fulcrum shaft 71, and regulates the pivoting of the cover fulcrum shaft 71. The wall parts 214 sandwich the bent part 71*a* of the cover fulcrum shaft 71 in the X direction, and regulate the X-directional movement of the cover fulcrum shaft 71. With the bent part 71*a* of the cover fulcrum shaft 71 engaged in the engaging part 212, the cover fulcrum shaft 71 is thereby held so as to not pivot relative to the opening and closing cover 203. The protruding part 213 is equivalent to the "first engaging part" of the present disclosure, and the wall parts 214 are equivalent to the "second engaging parts" of the present disclosure.

Figure 8:
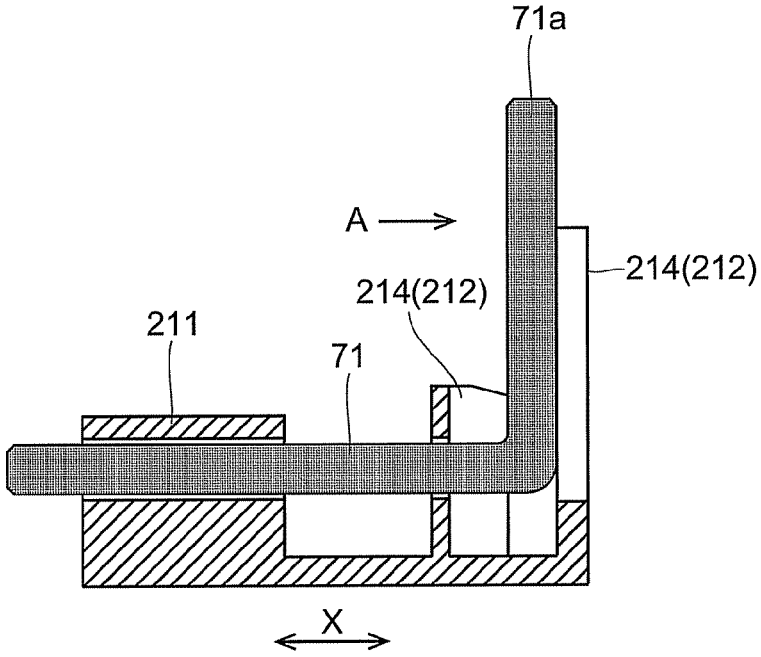
FIG. 8 is a drawing for describing the opening and closing structure of the opening and closing cover of the image formation apparatus shown in FIG. 1 (a drawing of the engagement released between the engaging part and the bent part of the cover fulcrum shaft).
Figure 9:
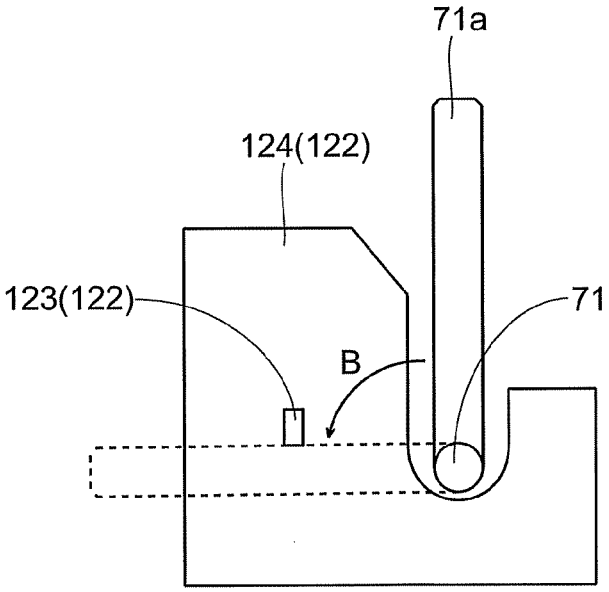
FIG. 9 is a view from the direction of arrow A in FIG. 8.

The engaging part 212 is formed integrally in the inner surface of the opening and closing cover 203, and is capable of elastic deformation. Therefore, when the bent part 71*a* of the cover fulcrum shaft 71 and the engaging part 212 are engaged, the engaging part 212 is elastically deformed and the cover fulcrum shaft 71 is preferably pivoted a predetermined amount in the B direction (see FIG. 9) relative to the opening and closing cover 203 from the state in which the bent part 71*a* of the cover fulcrum shaft 71 and the engaging part 212 are not engaged (the state shown in FIGS. 8 and 9).

(Grounding Connection to Main Body Frame)

Figure 10:
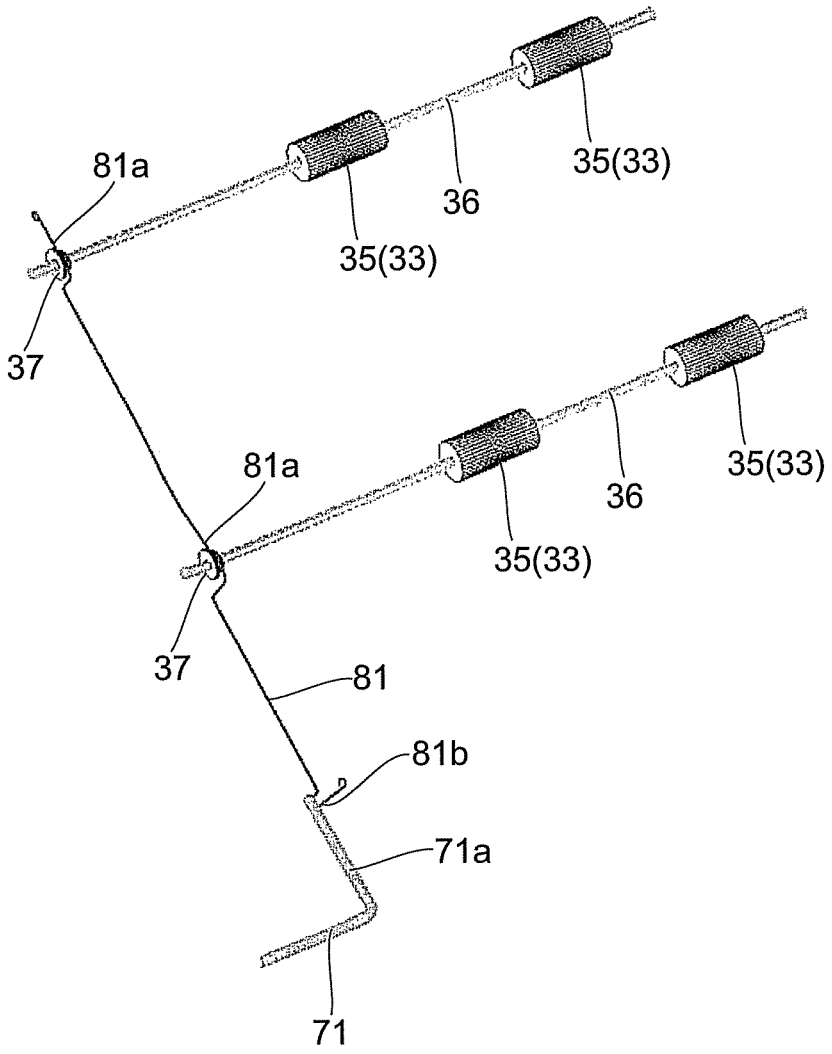
FIG. 10 is a drawing for describing the connecting structure of the grounding member disposed on the opening and closing cover of the image formation apparatus shown in FIG. 1.

In the present embodiment, to suppress the accumulation of static electricity in the reversing rollers 35, the roller shafts 36 and the cover fulcrum shaft 71 are electrically connected by a grounding wire 81, and the roller shafts 36 are grounded to the main body frame 100*a* via the cover fulcrum shaft 71, as shown in FIG. 10. The grounding wire 81 is equivalent to the "grounding member" of the present disclosure.

Figure 11:
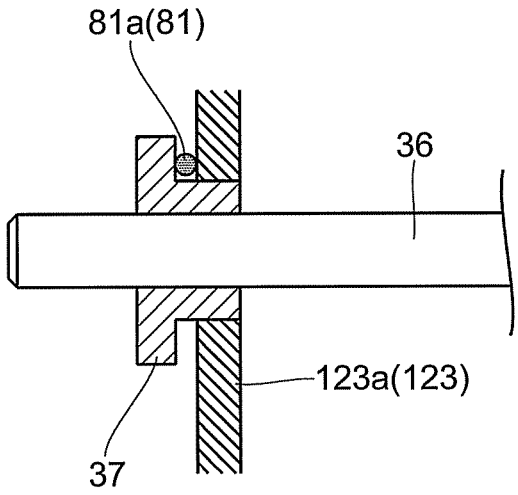
FIG. 11 is a drawing for describing the securing structure of the first portion of the grounding member shown in FIG. 10.

The grounding wire 81 has first portions 81*a* electrically connected to the roller shafts 36, and a second portion 81*b* electrically connected to the cover fulcrum shaft 71. The first portions 81*a* of the grounding wire 81 are sandwiched between the bearings 37 and an outer wall part 123*a* of the guide frame 123 provided to the opening and closing cover 203, as shown in FIG. 11. The bearings 37 are formed from an electroconductive material. The first portions 81*a* of the grounding wire 81 is thereby electrically connected to the roller shafts 36 via the bearings 37.

The second portion 81*b* of the grounding wire 81 is in contact with the bent part 71*a* of the cover fulcrum shaft 71 engaged in the engaging part 212 as shown in FIG. 7, and is thereby electrically connected to the cover fulcrum shaft 71. Specifically, the second portion 81*b* of the grounding wire 81 is held in a predetermined position CP where the second portion can be in contact with the bent part 71*a* of the cover fulcrum shaft 71 engaged in the engaging part 212. The second portion 81*b* of the grounding wire 81 thereby comes in contact with the bent part 71*a* of the cover fulcrum shaft 71 when the bent part 71*a* of the cover fulcrum shaft 71 is engaged in the engaging part 212. The second portion 81*b* of the grounding wire 81 also ceases to be in contact with the bent part 71*a* of the cover fulcrum shaft 71 when the engaging of the bent part 71*a* of the cover fulcrum shaft 71 and the engaging part 212 is released (when the cover fulcrum shaft 71 pivots relative to the opening and closing cover 203).

Figure 12:
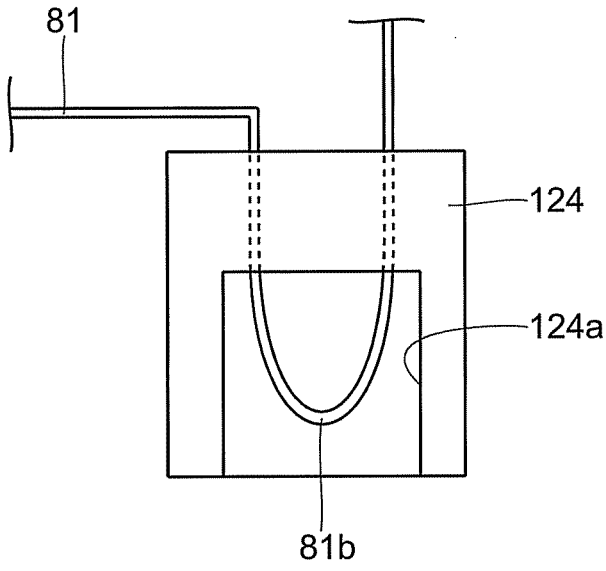
FIG. 12 is a drawing for describing the securing structure of the second portion of the grounding member shown in FIG. 10.

In the predetermined position CP (the position where the second portion 81*b* of the grounding wire 81 is held), a securing part 124 is provided for securely holding the second portion 81*b* of the grounding wire 81 in the predetermined position CP, as shown in FIGS. 6 and 12. For example, the securing part 124 is designed so that the second portion 81*b* of the grounding wire 81 can be inserted through. The securing part 124 has an opening 124*a* through which part of the second portion 81*b* of the grounding wire 81 inserted through the interior is exposed and brought in electrical contact with the bent part 71*a* of the cover fulcrum shaft 71. Exposed from the opening 124*a* of the securing part 124, the second portion 81*b* of the grounding wire 81 protrudes slightly toward the bent part 71*a* of the cover fulcrum shaft 71. The bent part 71*a* of the cover fulcrum shaft 71 engaged in the engaging part 212, together with the securing part 124, sandwiches the second portion 81*b* of the grounding wire 81. The second portion 81*b* of the grounding wire 81 is curved into a substantially U-shaped configuration, and the substantially U-shaped crooked second portion 81*b* of the grounding wire 81 is inserted through the securing part 124. Specifically, the substantially U-shaped crooked second portion 81*b* of the grounding wire 81 is sandwiched in between the securing part 124 and the bent part 71*a* of the cover fulcrum shaft 71.

The image formation apparatus 100 of the present embodiment, as described above, comprises the opening and closing cover 203 pivotably supported on the main body frame 100*a* of the apparatus main body, the cover fulcrum shaft 71 for pivotably supporting the opening and closing cover 203 on the main body frame 100*a*, and the roller shafts 36 disposed on the opening and closing cover 203 and rotatably supporting the reversing rollers 35 (conveying rollers) for conveying the paper P (recording medium). The image formation apparatus 100 further comprises the grounding wire 81 (grounding member) disposed on the opening and closing cover 203 and having the first portions 81*a* electrically connected to the roller shafts 36 and the second portion 81*b* electrically connected to the cover fulcrum shaft 71, the grounding wire being for grounding the roller shafts 36 to the main body frame 100*a* via the cover fulcrum shaft 71. The cover fulcrum shaft 71 has the bent part 71*a* bent so as to extend in a direction intersecting the X direction (the pivot axis direction of the cover fulcrum shaft 71), the opening and closing cover 203 includes the engaging part 212 capable of engaging with the bent part 71*a* of the cover fulcrum shaft 71, and the cover fulcrum shaft 71 pivots integrally with the opening and closing cover 203 when the opening and closing cover 203 opens and closes, due to the engaging of the bent part 71*a* of the cover fulcrum shaft 71 in the engaging part 212.

In the configuration of the present embodiment, the cover fulcrum shaft 71 is formed so as to have the bent part 71*a* extending in a direction intersecting the X direction, and the engaging part 212 capable of engaging with the bent part 71*a* of the cover fulcrum shaft 71 is provided to the opening and closing cover 203, whereby the cover fulcrum shaft 71 can easily be made to pivot integrally with the opening and closing cover 203 when the opening and closing cover 203 opens and closes (when it pivots), merely by engaging the bent part 71*a* of the cover fulcrum shaft 71 in the engaging part 212. The cover fulcrum shaft 71 also pivots integrally with the opening and closing cover 203 when the opening and closing cover 203 opens and closes due to the bent part 71*a* of the cover fulcrum shaft 71 being engaged in the engaging part 212, and the second portion 81*b* of the grounding wire 81 therefore does not slide over the peripheral surface of the cover fulcrum shaft 71 (the position where the second portion 81*b* of the grounding wire 81 contacts the cover fulcrum shaft 71 is not displaced) even when the opening and closing cover 203 is opened and closed. It is therefore possible to suppress cutting of the second portion 81*b* of the grounding wire 81, and changes in the contact pressure between the second portion 81*b* of the grounding wire 81 and the cover fulcrum shaft 71. As a result, it is possible to suppress occurrences of poor electrical connection between the grounding wire 81 and the cover fulcrum shaft 71.

In the present embodiment, the engaging part 212 is formed to be capable of elastic deformation as described above. From a state in which the bent part 71*a* of the cover fulcrum shaft 71 and the engaging part 212 are not engaged, the bent part 71*a* of the cover fulcrum shaft 71 and the engaging part 212 are engaged by elastically deforming the engaging part 212 and causing the cover fulcrum shaft 71 to pivot a predetermined amount relative to the opening and closing cover 203. If the configuration is designed in this manner, the bent part 71*a* of the cover fulcrum shaft 71 can easily be engaged in the engaging part 212.

When the opening and closing cover 203 is pivotably supported on the apparatus main body, after inserting the cover fulcrum shaft 71 through the support part 211 of the opening and closing cover 203 and fitting the tip portion of the cover fulcrum shaft 71 protruding from the support part 211 into the bearing part (not shown) of the main body frame 100*a*, the cover fulcrum shaft 71 need only be pivoted a predetermined amount relative to the opening and closing cover 203 while the engaging part 212 is elastically deformed. Therefore, the opening and closing cover 203 can easily be attached to the apparatus main body even if the cover fulcrum shaft 71 is formed into a substantial L shape (a shape having the bent part 71*a*).

When the opening and closing cover 203 is taken off the apparatus main body, the cover fulcrum shaft 71 is preferably pivoted a predetermined amount relative to the opening and closing cover 203 in the opposite direction from when it is attached, while the engaging part 212 is elastically deformed. Doing so allows the cover fulcrum shaft 71 to move in the X direction and enables the cover fulcrum shaft 71 to be pulled out from the bearing of the main body frame 100*a* (enables the opening and closing cover 203 to be taken off the apparatus main body). Specifically, the opening and closing cover 203 can be taken off the apparatus main body in a simple manner (there is no loss of operability in the maintenance operation involved with taking off the opening and closing cover 203).

In the present embodiment, the second portion 81*b* of the grounding wire 81 is held in the predetermined position CP where it can be in contact with the bent part 71*a* of the cover fulcrum shaft 71 engaged in the engaging part 212, as described above. If the configuration is designed in this manner, the bent part 71*a* of the cover fulcrum shaft 71 can be brought in contact with the second portion 81*b* of the grounding wire 81 merely by engaging the bent part 71*a* of the cover fulcrum shaft 71 in the engaging part 212 when the cover fulcrum shaft 71 is attached to the opening and closing cover 203. There is thereby no need for any special operation for electrically connecting the cover fulcrum shaft 71 and the grounding wire 81, and operability is improved.

In the present embodiment, in the predetermined position CP (the position where the second portion 81*b* of the grounding wire 81 is held), the securing part 124 is provided for securely holding the second portion 81*b* of the grounding wire 81 in the predetermined position CP, as described above. If the configuration is designed in this manner, it is possible to easily suppress occurrences of the inconvenience of second portion 81*b* of the grounding wire 81 coming out of position and ceasing to be in contact with the bent part 71*a* of the cover fulcrum shaft 71.

In the present embodiment, the bent part 71*a* of the cover fulcrum shaft 71, together with the securing part 124, sandwiches the second portion 81*b* of the grounding wire 81 as described above. If the configuration is designed in this manner, the second portion 81*b* of the grounding wire 81 and the bent part 71*a* of the cover fulcrum shaft 71 can be reliably brought in contact, and poor electrical connection is unlikely.

In the present embodiment, the second portion 81*b* of the grounding wire 81 is curved into a substantially U-shaped configuration as described above. The substantially U-shaped crooked second portion 81*b* of the grounding wire 81 is sandwiched between the securing part 124 and the bent part 71*a* of the cover fulcrum shaft 71. If the second portion 81*b* of the grounding wire 81 is curved into a substantially U-shaped configuration in this manner, the second portion 81*b* of the grounding wire 81 is easily sandwiched.

In the present embodiment, the engaging part 212 has the protruding part 213 (the first engaging part) protruding toward the pivot path of the bent part 71*a* of the cover fulcrum shaft 71, and the wall parts 214 (the second engaging parts) for sandwiching the bent part 71*a* of the cover fulcrum shaft 71 in the X direction, as described above. If the configuration is designed in this manner, the cover fulcrum shaft 71 can be reliably held so that the cover fulcrum shaft 71 pivots integrally with the opening and closing cover 203 when the opening and closing cover 203 opens and closes (when it pivots). Because the X-directional movement of the cover fulcrum shaft 71 is regulated by the wall parts 214, the cover fulcrum shaft 71 is kept from coming loose.

The embodiment disclosed herein is an example in all points and should not be construed as being limiting. The range of the present disclosure is set forth by the claims rather than the description of the above embodiment, and meanings equivalent with the claims and all variations belonging within their scope are included.

What is claimed is:

1. An image formation apparatus comprising:

an opening and closing cover pivotably supported on a main body frame of an apparatus main body;

a cover fulcrum shaft for pivotably supporting the opening and closing cover on the main body frame; and a roller shaft for rotatably supporting a conveying roller for conveying a recording medium, the roller shaft being disposed on the opening and closing cover; wherein the image formation apparatus further comprises a grounding member for grounding the roller shaft to the main body frame via the cover fulcrum shaft, the grounding member being disposed on the opening and closing cover and having a first portion electrically connected to the roller shaft and a second portion electrically connected to the cover fulcrum shaft;

the cover fulcrum shaft has a bent part that is bent so as to extend in a direction intersecting the pivot axis direction of the opening and closing cover, and the opening and closing cover includes an engaging part capable of engaging with the bent part; and due to the engaging of the bent part with the engaging part, the cover fulcrum shaft integrally pivots with the opening and closing cover when the opening and closing cover is opened and closed.

2. The image formation apparatus according to claim 1, wherein the engaging part is formed so as to be able to elastically deform; and from a state in which the bent part and the engaging part are not engaged, the bent part and the engaging part engage due to the engaging part elastically deforming and the cover fulcrum shaft being pivoted relative to the opening and closing cover.

3. The image formation apparatus according to claim 1, wherein the second portion is held in a predetermined position capable of contact with the bent part engaged in the engaging part.

4. The image formation apparatus according to claim 3, wherein a securing part for holding the second portion in the predetermined position is provided to the predetermined position.

5. The image formation apparatus according to claim 4, wherein the second portion is inserted through the interior of the securing part;

the securing part has an opening for exposing part of the second portion inserted through the interior of the securing part; and part of the second portion exposed through the opening is in contact with the bent part.

6. The image formation apparatus according to claim 4, wherein the bent part and the securing part together sandwich the second portion.

7. The image formation apparatus according to claim 6, wherein the grounding member is made of an electroconductive wire, and the second portion is curved into a substantially U-shaped configuration.

8. The image formation apparatus according to claim 1, wherein the engaging part has a first engaging part protruding toward the pivot path of the bent part, and second engaging parts for sandwiching the bent part in the pivot axis direction.

9. The image formation apparatus according to claim 1, wherein the roller shaft is axially supported by a bearing formed from an electroconductive material; and the first portion is electrically connected to the roller shaft via the bearing.

* * * * *